United States Patent [19]

Toman et al.

[11] 4,374,502

[45] Feb. 22, 1983

[54] MECHANISM GENERATING HELICAL MOTION

[75] Inventors: George M. Toman, Chicago; Thomas J. Bock, Schaumburg; Chandrakant Bhatia, Buffalo Grove, all of Ill.

[73] Assignee: Union Special Corporation, Chicago, Ill.

[21] Appl. No.: 904,206

[22] Filed: May 9, 1978

[51] Int. Cl.³ ..... D05B 57/34

[52] U.S. Cl. ..... 112/162; 112/199; 112/220

[58] Field of Search ..... 74/52; 112/55, 199, 112/200, 201, 220, 221, 162

[56] References Cited

U.S. PATENT DOCUMENTS

| | | | |
|---|---|---|---|
| 2,704,042 | 3/1955 | Wallenberg et al. | 112/162 |
| 3,688,711 | 9/1972 | Szostak et al. | 112/221 X |
| 4,022,140 | 5/1977 | Lienemann | 112/199 |

FOREIGN PATENT DOCUMENTS

| | | | |
|---|---|---|---|
| 971914 | 10/1964 | United Kingdom | 112/162 |

OTHER PUBLICATIONS

Product Engineering, Sep. 28, 1959, pp. 66, 67.

*Primary Examiner*—W. C. Reynolds

*Attorney, Agent, or Firm*—John A. Schaerli; John W. Harbst

[57] ABSTRACT

The output centerpoint of a Cardan gear mechanism is connected via a ball and a pin slideable therethrough to a lever which in turn carries a looper. Because the major axis of the lever and the axis swept out by the output centerpoint are skewed the lever is reciprocated back and forth along its own major axis while being rotated therearound. This results in the looper being swept back and forth along part of a generally helical-like path.

7 Claims, 13 Drawing Figures

MECHANISM GENERATING HELICAL MOTION

This invention relates to a novel mechanism for converting continuous rotary input motion into reciprocating helical motion. More particularly it is concerned with reciprocating mechanisms such as used in industrial sewing machines producing Class 500 stitches, commonly known as overedge stitches, wherein a thread carrying element known as a looper or spreader is required to move a thread, or threads, from a position below the plane of the material being sewn around the edge of the material and to coincide with a needle in some fixed geometry above the material.

Sewing machines producing what is known as an overedge stitch are well known in the art. These stitches are generally included in Federal Stitch Class 500 the more popular being, for example, stitch type 502, 503 and 504. In the formation of, for example, the 504 stitch (see FIGS. 8–11) there is employed in combination with the needle 500 and lower looper 502 an upper looper means 504. The upper looper 504 picks up the lower looper thread 510 at a point normally below the plane of the fabric means 506 as shown in FIG. 9. The upper looper 504 passes in back of the lower looper 502 to make this pickup. The upper looper 504 is then required to move upwardly and out such that it will pass through a point which is below and slightly in front of the tip 508 of the needle 500. While at this point it is required that the looper 504 dwell slightly such that the needle 500 as it starts downwardly on its path can enter the triangle of the looper thread formed on the backside of the looper 504 as shown in FIG. 10. Thus, it is apparent that the looper 504 must move from a position below and behind the needle 500 (shown in FIG. 9 where it intercepts the lower looper thread) to an upward position in front of the needle means 500 (shown in FIG. 10). For a complete discussion of type 504 stitch formation, reference should be made to "Stitch Formation Type 504" published by the Union Special Corporation, 400 N. Franklin St., Chicago, Ill. 60610.

A number of different mechanisms are generally employed in various machines producing an overedge type stitch to carry the lower looper thread from the underside to the edge of the material. These mechanisms conventionally consist of either multi-bar linkage systems or barrel cam systems driven from a main drive crankshaft in the sewing machine through compounded systems of connecting rods, eccentrics, linkages and straps. Due to the difficulty of balancing the required motion, there exist large unbalanced inertial forces and moments in such mechanisms which are a source of high noise and vibration. In addition the compounded system of links and eccentrics employed in one type of mechanism are difficult to lubricate and present problems in wear, overthrow and temperature at high speeds. Mechanisms depending on a stationary helical barrel cam present similar problems in the sliding motion of the cam follower along the helical track and the compound connection means required from the main crankshaft.

It is an object of this invention to provide an apparatus in which essentially helical reciprocating output motion is provided directly from continuous rotary input motion without the intermediary of a main machine crankshaft. A further object of this invention is to provide a mechanism capable of driving a thread carrying element, such as a looper or spreader, along a path consistent with a desired geometry in producing an overedge stitch. Yet another object of this invention is to provide such a mechanism in which the forces and moments produced during this helical motion are balanced and which consequently possesses greatly increased bearing life in addition to substantial reductions in noise and vibration. But another object of this invention is to provide a mechanism capable of driving a work performing means along at least a portion of a helical like curve.

In accordance with the invention, an apparatus is provided for moving a work performing means, an upper looper, for example, back and forth along a portion of a helical like path. A Cardan gear means having an output centerpoint which sweeps out a straight line is employed to reciprocate and rotate a lever which in turn carries the upper looper means. A bearing means constrains the lever means whereby it is free only to be reciprocated and rotated along a straight line path. A force transfer means joins the output centerpoint of the Cardan gear and the lever means and is capable of transferring translational and rotational force. The straight line path swept out by the output centerpoint means occupies a first plane which is spaced away from but parallel to a second plane which is occupied by the straight line path swept out by said lever means. The two straight lines are further skewed with respect to each other.

Other features and advantages of the invention will appear from the detailed description of a preferred embodiment of the same which will now be given in conjunction with the accompanying drawings in which.

Figure 1:
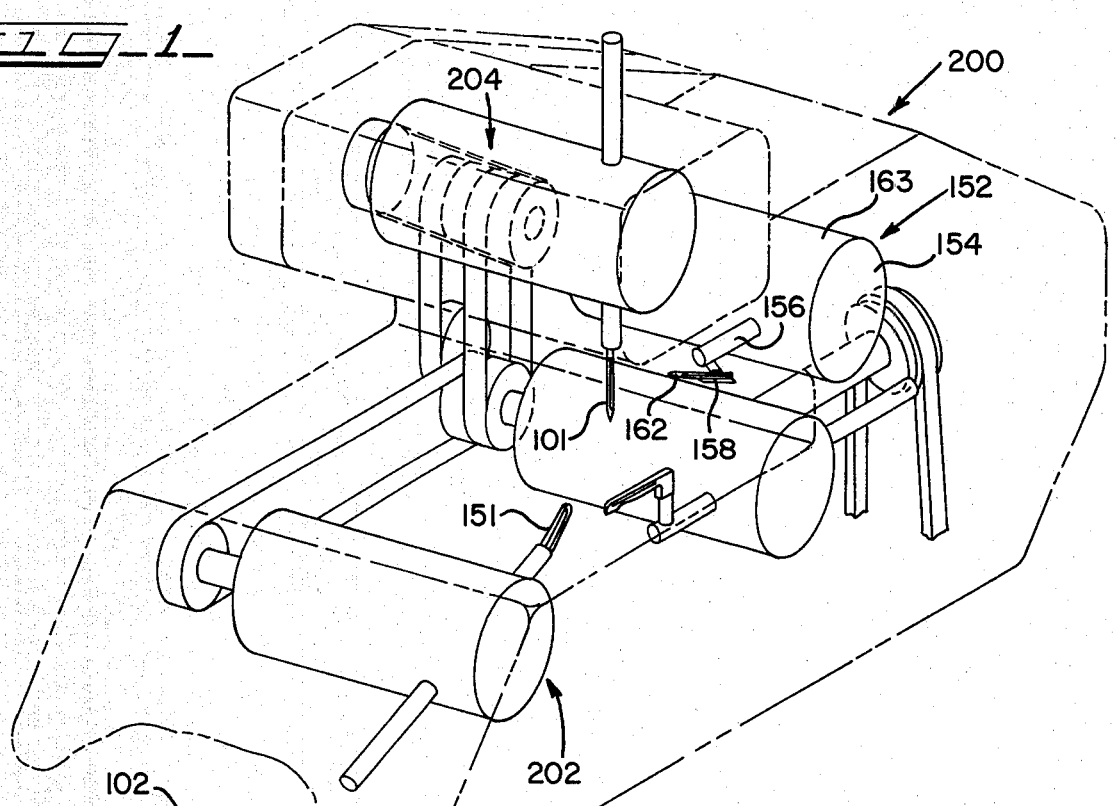
FIG. 1 is a partial isometric view in phantom lines of a sewing machine wherein the upper looper is driven by a Cardan gear type module.

Referring now to the above mentioned drawings, and to the stylized sewing machine 200 as shown in FIG. 1 the particular upper looper Cardan gear assembly 152 hereunder consideration includes Cardan gear means 154, the looper bar means 156 and the looper means 158. A series of Cardan gear modules are employed to drive the necessary elements which cooperate to form, for example, a 504 stitch. These include the lower looper Cardan module 202, the needle Cardan gear module 204 and the upper looper Cardan module 152.

Figure 2:
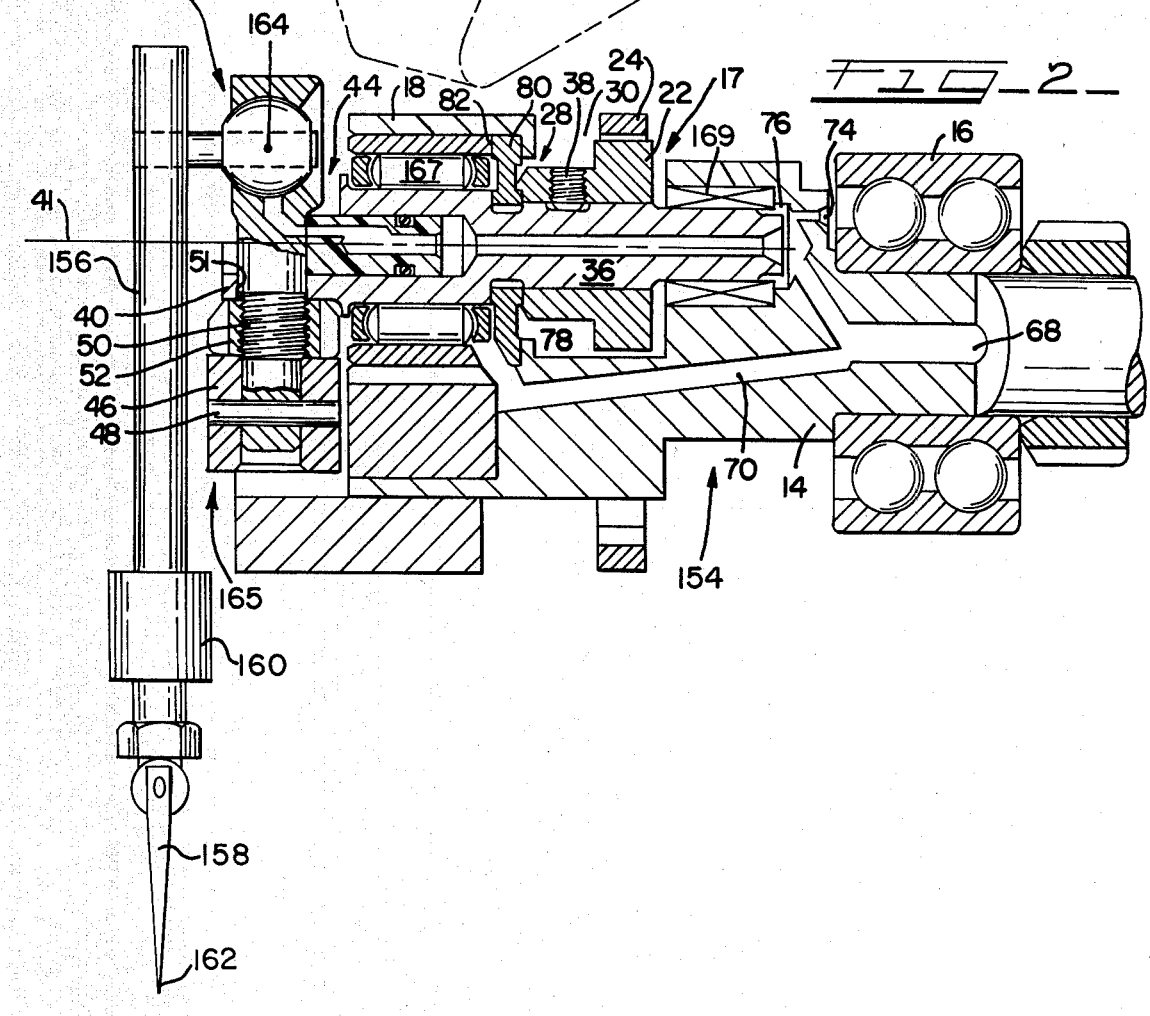
FIG. 2 is a partial view in horizontal section of the Cardan gear module and upper looper assembly.

The gear means 154 includes an enlarged extension or frame means 18 of drive shaft 14 supported in cantilever fashion from bearing 16. As shown, this frame means 18 is shaped to receive a pinion gear assembly 17 as shown in FIG. 2. The extension 18 is provided with a horizontally extending aperture or cavity 28, as well as a cutaway portion 30. As is apparent, the cutaway portion facilitates the engagement of the pinion gear means 22 with the internal ring gear 24 mounted within Cardan gear assembly 152. The aperture means 28 carries the double speed bearing means which includes first and second bearing sets 167 and 169 which journal the pinion shaft means 36. The set screw 38 is employed to secure the pinion gear 22 to the pinion shaft 36. Secured to the left end 40 of the pinion shaft 36 is a lever or connecting means 44 which connects the work performing instrumentality 156 thereto such that overall a cantilevered system is created. The lever means 44 also connects to the pinion shaft 36 a mass 46 which exerts force on said shaft whereby when balanced around line 41 there would be a zero load vector exerted on the double speed bearing means. In the preferred embodiment the mass exerting the force is a counterweight means 46 which is secured to lever means 44 with a pin means 48. The lever means 44 is provided with a threaded portion 50 designed for engagement with a spanner nut 52. In the preferred embodiment, the lever means is inserted through the aperture means 51 in the shaft means 36 and the spanner nut 52 securely locks the elements in a predetermined position.

The bearing sets hereunder discussion, that is, the main bearing set 16, the double speed bearing sets 167 and 169, and the force transfer means 102 are all provided with a positive oiling system. Oil enters main channel means 68 under pressure and thereafter passes via auxiliary channeling to each of the respective bearing sets. Bearing set 167 receives oil via channel means 70, bearing set 16 via channel means 72 and 74, bearing set means 169 via 72 and 76 and force transfer means 102 via channel means 72 and 78. Any suitable oil pumping system can be employed as is presently employed in conjunction with industrial sewing machines.

The pinion shaft 36 is secured in place by the provision of a thrust washer 80. A combination of the outer race 82 of the bearing set 167 on one side and the frame means 18 on the other secure thrust washer 80. In the preferred embodiment the thrust washer 80 is a material manufactured by the DuPont Corporation under the trade name "Vespel". The thrust washer 80 provides a substantially friction free abutting surface for the pinion gear 22 whereby the pinion shaft and related assemblies are fixed with regard to the frame assembly.

Further elements included in the upper looper Cardan gear means 154 shown more clearly in FIG. 2 and include: the output lever means 44, having an output centerpoint means 164, the force transfer means 102 and the bearing means 160. The Cardan gear means 154 itself hereunder consideration is more clearly explained in copending application Ser. No. 908,199, filed May 9, 1978. The force transfer means 102 as employed herein is also more clearly and succinctly disclosed in copending application Ser. No. 904,203, filed May 8, 1978. Suffice to to say, the force transfer means output centerpoint means always remains the same as the output centerpoint of lever means 44 and, therefore, is identified by the same reference numberal 164. In the preferred embodiment, the bearing means 160 comprises a portion of the cover and frame means 163 of the module 152.

Figure 4:
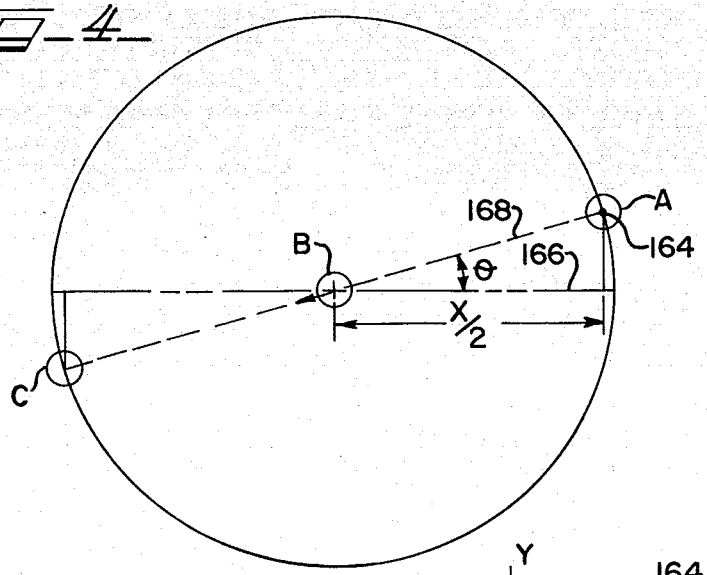
FIG. 4 is a diagrammatic view showing the path of movement of the center of the output pin and the path of movement swept out by the lever as it moves along its major axis.
Figure 3:
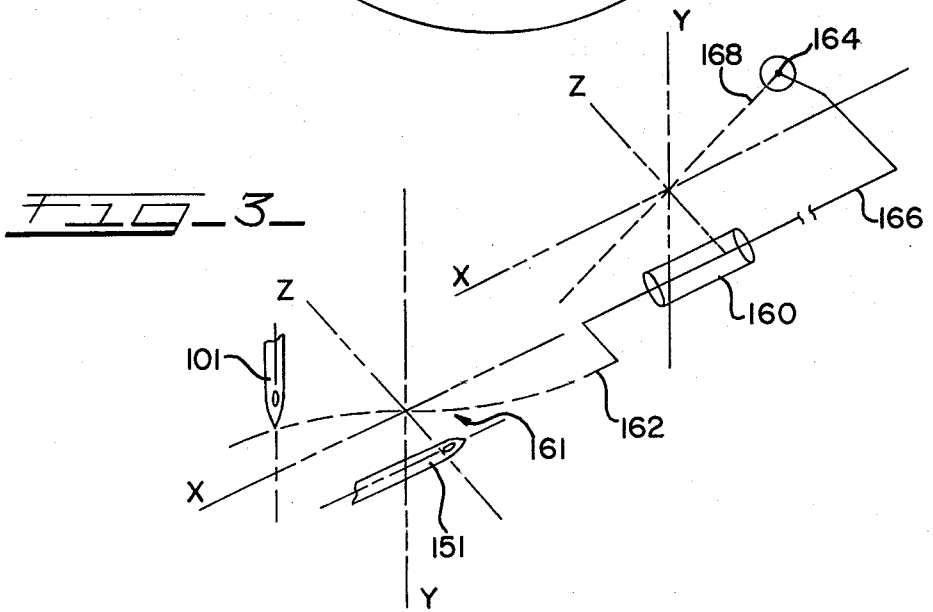
FIG. 3 is a diagrammatic view showing the path of movement of the center of the output pin and the corresponding path swept out by the tip of the upper looper.
Figure 8:
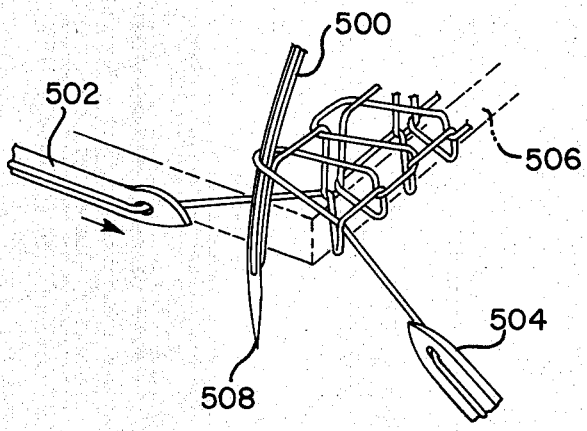
FIG. 8 PRIOR ART
FIGS. 8–11 are partial views showing one mode of 504 stitch formation as known in the prior art.
Figure 9:
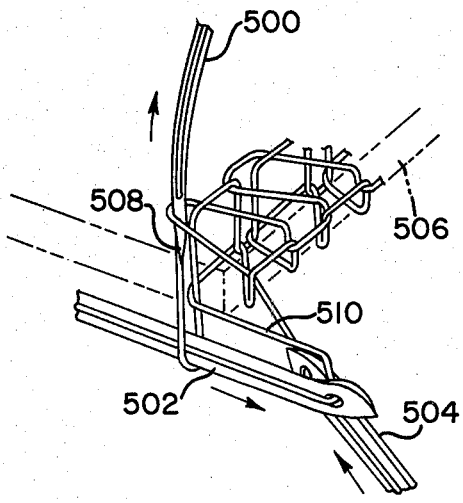
FIG. 9 PRIOR ART
Figure 10:
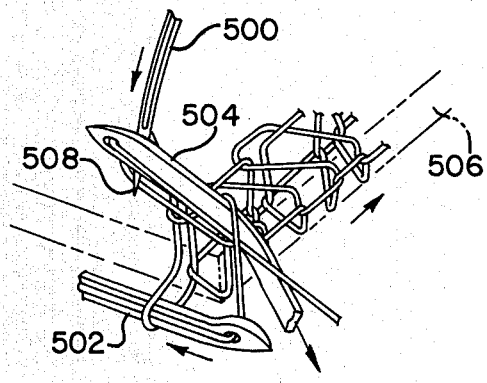
FIG. 10 PRIOR ART
Figure 11:
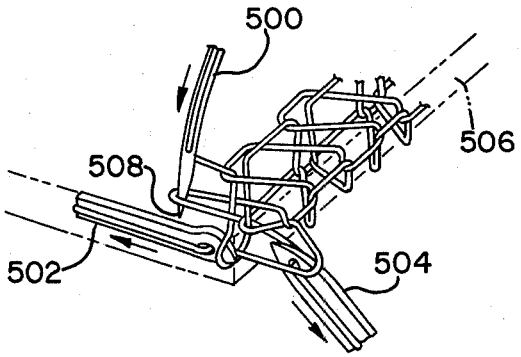
FIG. 11 PRIOR ART

Turning now to FIGS. 3 and 4 where the invention is disclosed in diagrammatic form for simplicity, it must be appreciated that the tip 162 of the looper will sweep out an upwardly extending helical path toward needle means 101. The straight line path swept out by the center of looper bar means 156 and a centerpoint 164 are represented by lines 166 and 168 respectively. These two straight line paths are in parallel spaced apart planes. That is in FIG. 4 path 168 would be within the plane of the paper while path 166 could be included in a plane somewhere above the plane of the paper. Both of these respective planes being parallel and spaced apart while the straight lines 166 and 168 are skewed at an angle theta to each other.

Figure 5:
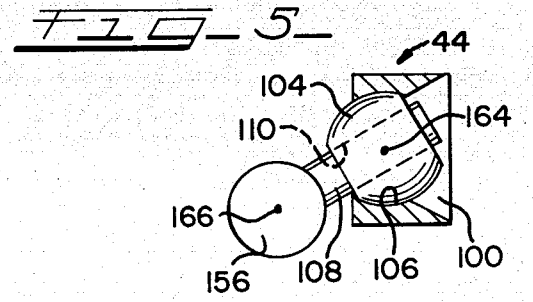
FIGS. 5, 6 and 7 are partial views showing the relationship of the force transfer means to the output means and the looper bar at different points during the work cycle.

The relationship of the looper bar 156 to the force transfer means 102 of the output lever 44 at the beginning of the cycle is shown in FIG. 5. The line 168 in FIG. 3 corresponds to that swept out by the output centerpoint means 164. As will be appreciated from a reading of copending application Ser. No. 904,203 filed May 9, 1978, the force transfer means 102 includes ball means 104 and a slider pin 108 which is carried within aperture means 110. The ball means 104 is carried within socket means 106 such that the pin means 108 slides therein while the ball means is capable of turning within socket means 106.

Figure 6:
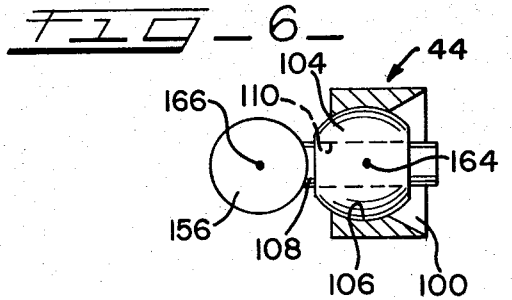
Figure 7:
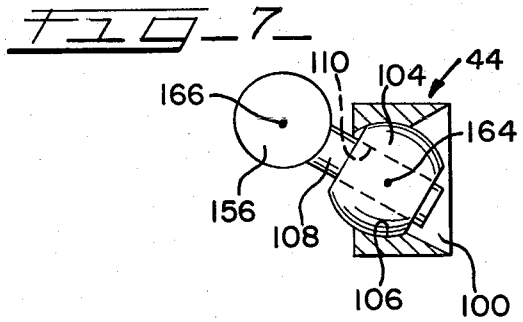

At the beginning of the cycle, represented by "A" in FIG. 4, the upper looper bar 156, force transfer means 104 and lever means 44 are in the position shown in FIG. 5. As the assemblies move toward position "B" in FIG. 4 which correspond to FIG. 6, translational and rotational forces have been transferred to looper bar 156. Because the centerlines of shaft 156 corresponds to line 166 and the output centerpoint 164 corresponds to line 168 both as shown in FIG. 3 it is apparent that the pin 108 will slide farther into the ball means 104. This sliding is accomplished with the resulting rotation of the shaft 156. The stroke or translational distance will correspond to the distance X/2 as shown in FIG. 4. As the force transfer means 102 continues thereafter to be swept along path 168 it eventually reaches the end of the stroke represented by "C" in FIG. 4. The tip 162 of the looper means 158 during this time is sweeping out a path corresponding to path 161 shown in FIG. 3. In a preferred embodiment the tip 162 is swept through only a portion of the total possible helix. The motion, however, carries it in back of the lower looper means 151 and in front of the needle means 101. In position "C" the respective elements assume the orientation as shown in FIG. 7, the looper bar means 156 having been rotated through an angle and reciprocated through a stroke or translational distance of X. The return stroke is back along the same path, corresponding to path 168 in FIG. 4, whereby passing through position "B" to initial position "A", while the tip of the looper 162 passing back along path 161. This constitutes a complete work cycle necessary to form a single stitch. As is appreciated during this cycle the output centerpoint 164 moves in X and Y dimensions, while the looper tip 162 moves in the X, Y and Z dimensions. A point on the center of looper bar 156, however, moves only in the X dimension.

The stroke or translational distance that the looper bar means 156 is moved through depends upon the stroke of the output lever means 44. The stroke of the output lever means 44 in turn depends directly upon the size of the Cardan gear being employed to drive it. As is appreciated in order to achieve a straight line output the centerpoint 164 must be positioned directly upon the pitch diameter of the internal ring gear 24. As stated previously further information on the construction and mode of operation of the Cardan gear assembly reference should be made to copending application Ser. No. 908,199. The helical path 161 as shown in FIG. 3 is achieved by skewing the path 168 swept out by the output center means 164. The magnitude of theta will determine both the rotation and the translation of the helical path 161. The larger the angle the greater will be the rotation of the helical path and the shorter the translation. Conversely the smaller the magnitude of angle theta the greater the translation and smaller the rotation of the helical path. It should be appreciated that in the embodiment herein disclosed, it is possible to achieve only about the first 90° of the helix. This restraint is placed upon the system because of the design of the force transfer means 102. In order to perform the necessary sewing function it has been found the path 161 swept out by the tip 162 of the looper 158 need only be advanced through about the first 72° of the possible 360° which constitute the total helix angle. An important factor, however, is that planer motion is being translated into spatial output.

The particular angle theta which exists between the paths 166 and 168 can be achieved in various manners. For example, the support means for the bearing 160 can be provided with an adjusting means. The adjusting means allows the angle theta to be varied within a predetermined range. Another mode of adjustment involves the housing support of the Cardan gear assembly. The housing support can be provided with an adjustment whereby the entire Cardan gear can be rotated one way or the other to create the desired angle.

As will be further discussed, due to the rotational movement of the slider pin 108, looper bar 156, and looper 158 with its holder, the resulting rotational inertia unbalance must be considered. It was found, however, that certain adjustments could be made in the pinion counterweight means 165 such that an acceptable mechanism would result. Specifically, depending upon other parameters, mass was added or subtracted up to ±15% of the total weight thereof until the load vector and moment acting on the double speed bearing means 167 and 169 are modified to produce a more desirable balancing situation. A preferred change in mass is in the range of ±5%.

Figure 13:
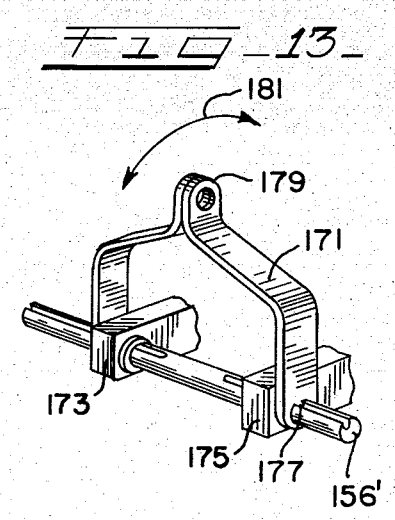
FIG. 13 shows a means where the rotating motion only is employed to drive a mechanism.

The assembly shown in FIG. 13 transfers rotational motion of the looper bar means 156' in pivotal movement on the part of bracket means 171. Support bearing means 173 and 175 secure the bracket means 171 against translational movement as the looper bar 156' reciprocates while a spline and key way means 177 connect the elements for the transfer of rotational movement, the result being that the output end 179 pivots back and forth generally along arch 181. With suitable linkage means such pivotal motion can be employed to drive the feed dog means found associated with standard sewing machines.

Balancing of the Cardan gear module means has been pursued with the intent of either minimizing or at best eliminating the effects of inertia forces on the operating quality of the system. It has been found that the degree to which the unresolved inertia forces can be minimized or eliminated will depend upon the particular path through which the work performing means is being driven. If the inertia forces in the system were not resolved their presence could result in fluctuating and reversing loads which in turn could produce increased stress in members, and impacts between loosely fitted elements. The result being higher noise levels and wear and reduced fatigue life of the loaded elements.

Balancing of the system may be approached from two different directions. The first approach is on a theoretical level which attempts to predict the state of the unresolved inertia forces and develop their solutions prior to actual manufacture of the component parts. A second method utilizes actual parts and analyzes their unresolved inertia forces due to manufacturing tolerances, for example, by using a balancing machine. This second method as is apparent is well known in the art and therefore no further discussion will be made thereto.

By employing the theoretical approach a theoretical model of a Cardan gear means can be developed. In this particular model through an understanding of the unresolved inertia forces it is possible to make intelligent selection of bearing and the selection and assignment of materials to obtain reasonable stress levels. Additionally, it is possible to proportion the mass of the various elements in order to resolve the inertia forces. The first step in developing the theoretical model is to establish the mode of operation and the function of the Cardan gear system. Specifically, the Cardan gear means operates in a dynamic mode and is capable of driving an output element or work performing means along several different paths of motion. For example, various paths being straight line, helical, ellipse like or a combination of helical and elliptical.

Thus prior to actual design the motion of the work performing means is fixed or decided upon. The geometric relationship of the Cardan gear elements is thus established. To facilitate the development of the mathematical model several assumptions are made about the physical properties of the system under consideration. First, all elements of the mechanism are considered rigid bodies. The effects of deflection are assumed negligible as to their effects on inertial balancing. Secondly, the natural frequency of all the elements is considered to be above the normal operating frequency of the Cardan gear mechanism. Thirdly, the mass of the various mechanical components are lumped. Thus the dynamic analysis of only a few discrete points need be conducted. The lumping, of course, consists of concentrating all of the elements massed at the center of gravity thereof. Lastly the main crank or drive shaft input angular velocity is held constant.

Figure 12:
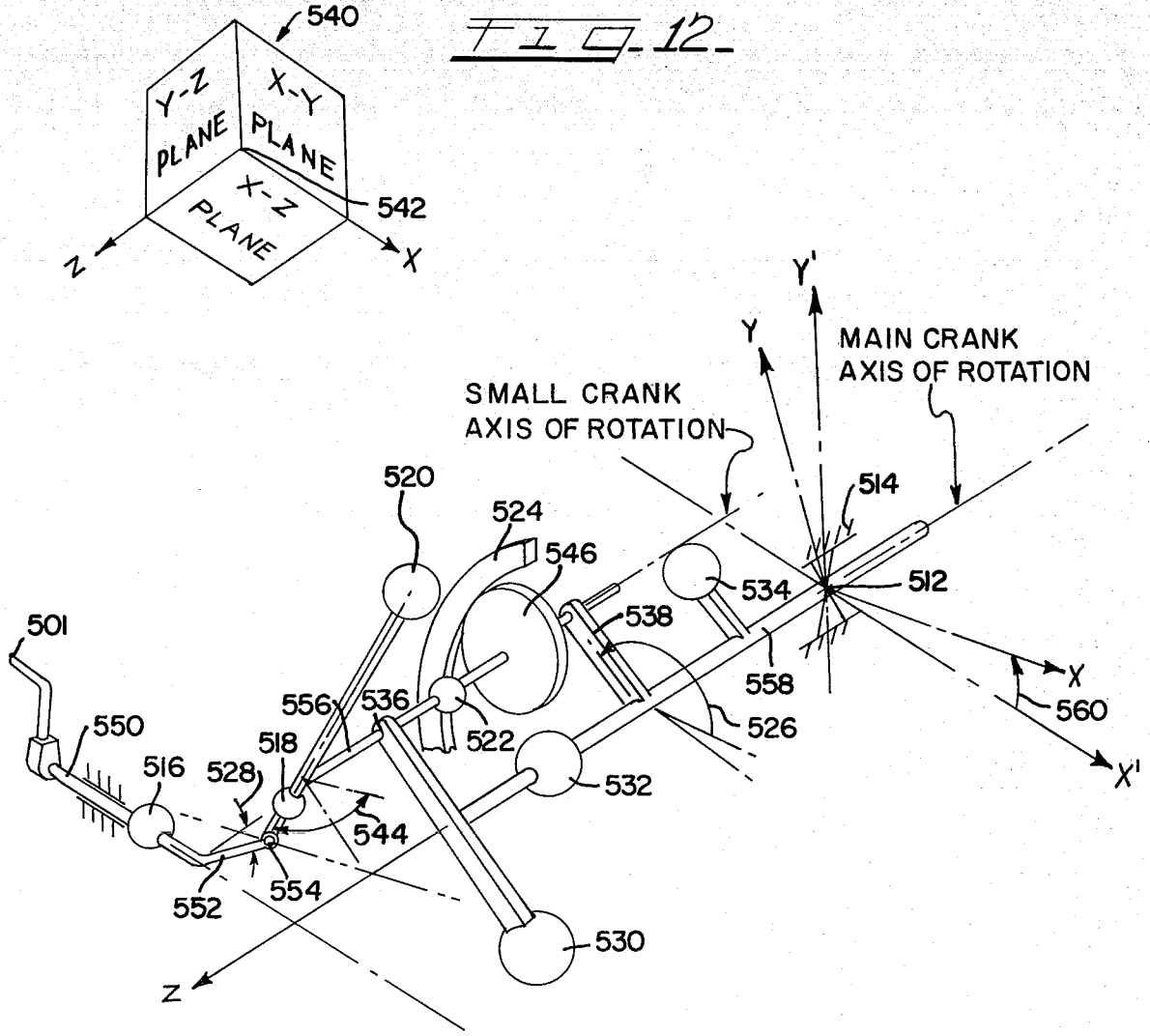
FIG. 12 is a model representation showing various factors acting upon the system during a work cycle.

The components or elements which comprise the Cardan gear means are broken down into their basic groups. The dynamic inertia forces of the most basic group is then analyzed. These forces are then superimposed on the second basic group and that group is balanced. The resulting forces are then superimposed upon the third basic group which is ultimately balanced. As shown in FIG. 12, the first basic group includes the looper means 550 and everything carried thereby as well as the slider pin mortion 552 of the force transfer means 554 which is secured to the looper bar means. The second basic group includes the small crank or pinion shaft 556 and everything carried thereby. The third basic group encompasses the main crank or main drive shaft 558 and all elements carried thereby. In each of these basic groups the masses are lumped in such a manner as to retain the same inertial properties as the actual group. All of this results in a simplified theoretical model of a Cardan mechanism in which a few lumped masses with a specific positional relationship to each other represent the actual mechanism.

Referring to FIG. 12 two spatial right hand coordinates systems have been established for specifying the relationships of the basic components to each other.

The global coordinate systems have been established for specifying the relationships of the basic components to each other. The global coordinate system defined in terms of X' and Y', has the looper bar means or output bar 550 orientated with respect to it. The main drive shaft 558 and the pinion shaft 556, however, are orientated with respect to a local coordinate system. The local coordinate system (defined in terms of X, Y and Z) lies directly on the global coordinate system and can rotate about one common axis which in practice is Z. This common Z axis as will be noted is also the axis of rotation of the main drive shaft 558. As is appreciated in order to drive the tip of the work performing means 501 through certain motions such as, for example, helical or helical/elliptical, it is required that the local system be rotated (skewed) with respect to the global system. The angle 560 represents the amount of skew. This entails using a coordinate transformation to go from one system to another. Both coordinate systems are fixed and do not move in any way with respect of any of the Cardan gear elements as they travel through a work cycle. Both the global and local coordinate systems have their origin at the center 512 of the main bearing means 514. The planes of interest wherein various basic components operate, are defined by two axes of a given coordinate system.

With the theoretical model decided upon the mathematical equations defining the kinematic properties thereof may be developed. Since the inertial forces of the looper bar means 550 and other components in the first basic group cannot be easily balanced within themselves the load is transferred to the pinion shaft 556. The point of lumped mass thereof being represented at 516. The pinion shaft as shown in FIG. 12 is represented by three lumped masses 518, 520 and 522 and three points of force interaction. These points of force interaction corresponding to the two double speed bearing means 536 and 538 and the force transfer means 554. The looper means 550 inertia load is transferred through one point of force interraction, i.e., the force transfer means 554, and the two double speed bearing means simulate the support for the pinion shaft or small crank 556. The ring gear 524 is not considered a point of force interaction in the kinematic analysis and only serves as a geometric constrain for pinion shaft 556. Because the pinion shaft 556 is restrained in a cantilevered fashion and also because of space limitations, it is not easy to balance off the unresolved inertia forces in two planes. Therefore, the mathematical analysis of the small crank is conducted in a single plane (static balancing). This is a parallel X, Y plane located through the pinion shaft counter weight lumped mass 520. The lumped mass of the pinion shaft double speed bearing journal and pinion shaft itself are neglected for the present because they lie on the line of rotation. Three kinematic position relationships can be developed for the pinion shaft 506, counterweight and strap lumped mass points 518 and 520 and the point of work performing means force interaction 504. These three relationships uniquely define the independent variables (crank angle 526) relationship with the dependent variables (the position of points with respect to main shaft or crank). One further kinematic position relationship is required. The looper means rotational relationship with respect to the independent variable is needed to fully define this subsystem. The angle 528 defines the amount of this rotation. The angle 544 defines the angular relationship between the pinion shaft 556 and the local coordinate system. This relationship is fixed by the constraint of the pinion gear 546 and ring gear 524 engagement.

The first derivative of these four relationships will produce the velocity of the points of concern. The second derivative will produce the accelerations of these points. The utilization of Newton's second law of kinetics will determine both the magnitude and the direction of the unresolved inertia forces acting in this particular X, Y plane of the pinion shaft 556. As is appreciated all of the masses and geometric relationships being developed are set up in general form allowing changes to be made to any variable with the purpose of optimizing the system. When the summation of the inertial forces remains constant and the summation of the moment about the pinion shafts axis of rotation equal zero for 360° of rotation of the main shaft, the pinion shaft 556 may be considered statically balanced in the X, Y plane. That is the pinion shaft 556 is considered balanced around its major axis. It will be noted that when the moment about the pinion shaft 556 equals zero, the constant resultant vector force radially rotates around the main shaft at the main shafts angular velocity. This fact allows balancing of this inertia force on the main shaft 558 by adjusting the main crank counter balance mass 530 180° out of phase thereby obtaining an equilibrium of forces and moments with respect to the main bearing set.

The main shaft 558 inertia force analysis is done in two planes (static and dynamic balancing). The main shaft and related elements are represented by three lumped masses 530, 532 and 534, and three points of force interaction being the main bearing 514, and the two double speed bearing means 536 and 538. The first step in resolving the inertia forces of the main shaft is to transfer all of the pinion shaft 556 resultant forces to the double speed bearing points of force interaction 536 and 538. These forces will act on the main shaft 558 in equal magnitudes but in opposite directions. When all the forces and moments (transferred and inertial) acting on the main shaft 558 at the center 512 of the main bearing 514 in two planes is equal to zero, the main shaft can be considered balanced both statically and dynamically. Since the transferred and inertia forces acting on the main shaft 558 remain constant through an operating cycle the main shaft needs to be balanced at only one position. The main shaft counterweight mass 530 may be adjusted independently in the two balancing planes. These two planes are the X-Y and the Y-Z planes, which both pass through the center of the main bearing. For clarification, reference should be made to the orthographic plane representation 540 shown in FIG. 12. It should be noted that the point 542 projects into the plane of the page.

Several important aspects have arisen as a result of this analysis. First it will be noted that the mass of a counterweight, for example 520, can be reduced and positioned further from the axis of rotation and still retain its inertial equilibrium. This fact can be used on the pinion shaft 556 to reduce the constant resulting inertial forces to a lower magnitude whereby reducing the load at the double speed bearing. The result is a longer double speed bearing life and lower stress in the related parts. Secondly, from this analysis it is apparent that it is not necessary to balance the pinion shaft in two planes, rather, only static balancing is required. The resulting state of balance at the main shaft 558 is the same, regardless of whether or not the pinion shaft 556 is dynamically balanced.

The above analysis can be applied to at least four different work performing means and their related output path. Each of these various paths or motions presents their own particular relationships and problems. But, it must be noted that straight line motion can be considered separate from the elliptical, helical, and helical/elliptical motion. For example, with straight line motion or output of the work performing means, the balancing analysis is straightforward. Theoretically, the Cardan gear means which drives a work performing means along a straight line path can be totally balanced with the proper selection of the pinion shaft and main shaft counterweights. However, allowing for manufacturing tolerances, etc., it is appreciated that theoretical can never be absolutely achieved but rather only approached. The balancing of the elliptical, helical and helical/elliptical output motions proceeds in the same manner as that for straight line motion. However, as previously explained not only must the work performing means be reciprocated along the major axis of the looper bar 500 but it also must be rotated therearound (the angle 528 shown in FIG. 12). This gives rise to a rotational inertia torque which acts about the main axis of the looper means. Balancing in the conventional way will not resolve this torque. As the angle of rotation of the work performing means increases so does the magnitude of the inertia torque.

It has been found that by adjusting the pinion shaft counterweight mass 520 the inertial imbalance can be reduced or eliminated. For example, if the work performing means is being driven through an elliptical output motion it is possible to approach a totally balanced system. With both the helical and helical/elliptical output motions a larger looper bar means rotational angle is required. In this case adjustment to the pinion shaft counterweight mass is used to reduce the magnitude of force fluctuations and moment reversals on the small pinion gear to a minimum. Total balance of these two output motions cannot be brought to approach theoretical but can be brought to an acceptable level whereby the total Cardan gear mechanism can perform in an acceptable manner. In these two modes of output motion, gear reversal on the pinion shaft can be eliminated, allowing control of pinion gear impacts. As is appreciated, when the pinion shaft counterweight is treated in this manner, the pinion shaft will appear to be unbalanced when an attempt is made to balance it about its major axis. However, when assembled within the total Cardan gear means the entire assemblage when when balanced around the main bearing such as 514 will be optimumly balanced.

The utility of this invention is more fully explained in other copending U.S. patent applications. For example application Ser. No. 904,204, filed May 9, 1978, now U.S. Pat. No. 4,344,376, discloses an output which is along an elliptical path; application Ser. No. 908,199, filed May 22, 1978 discloses a balanced Cardan gear mechanism which generated motion along a straight line path; application Ser. No. 904,207, filed May 9, 1978 discloses a device which generates output along a helical/elliptical like path; application Ser. No. 904,203, filed May 9, 1978 discloses a force transfer means which links the Cardan gear module to the output device; and application Ser. No. 904,205, filed May 9, 1978 discloses a modularized sewing machine incorporating a series of Cardan gear module output devices.

What is claimed is:

1. A sewing machine having a mechanism for converting rotary motion into helical motion comprising:

a Cardan gear means having an output means sweeping out a straight line, said output means having an output center point;

a lever means carrying a work performing instrumentality and sweeping out a straight line;

a bearing means constraining said lever means whereby it is free to move only along and around its major axis;

a force transfer means capable of transferring translational and rotation force from said output means to said lever means and having the same output center point as said output means; and a means operatively associated with said Cardan gear means whereby the straight line swept out by said output means will be skewed with respect to the straight line swept out by the lever means.

2. A mechanism for moving an element of a stitch forming assembly along a helical path comprising:

a Cardan gear means having an output means which sweeps out a straight line path, said output means having an output center point;

a lever means movably secured in a bearing means whereby reciprocation and rotation are possible along and around a straight line path, said path being askew from the straight line path swept out by said output means; and a force transfer means having the same output center point as said output means for translating and transferring planer motion to spatial motion between said lever means and said output means.

3. A mechanism for reciprocating an element of a stitch forming instrumentality along a helical like path comprising:

a Cardan gear means;

an output means driven by said Cardan gear means sweeping out a first straight line path in a first plane, said output means having an output center point;

a lever means carrying said element of said stitch forming instrumentality;

a means operative carrying said lever means whereby it can be rotated and reciprocated along a second straight line path said path being skewed to said said first straight line path and in a second plane parallel to but spaced apart from said first plane; and a means operative to transfer motion between said output means and said lever means and having the same output center point as said output means.

4. The mechanism of claim 3 wherein:

said lever means is straight and elongated; and carries a thread handling means.

5. The mechanism of claim 4 wherein:

said lever means is a looper bar; and said element of a stitch forming instrumentality is a looper means designed to cooperate in the formation of a Class 500 type stitch.

6. A Cardan gear assembly means for actuating a work performing means comprising:

a balanced Cardan gear driving an output means, said output means having an output centerpoint means which sweeps out a straight line;

a lever means constrained by bearing means whereby only reciprocation and rotation around its major axis are possible, said major axis being skewed with respect to said straight line;

a ball and socket force transfer means for connecting said lever means and said output means, said force transfer means and said ouput means having the same output center point; and said work performing means carried by said lever means such that the work engaging portion sweeps out a portion of a helical like path.

7. A Cardan gear assembly means for driving a work performing tool means out and back along the same helical like path comprising:

an output means driven by said Cardan gear and sweeping out a straight line, said output means having an output center point;

a lever means having a major axis skewed to that of said output means and carrying said work performing tool means; and a force transfer means transmitting motion between said output means and said lever means and having the same output center point as said output means.

* * * * *